US009893398B2

(12) United States Patent
Taptič et al.

(10) Patent No.: US 9,893,398 B2
(45) Date of Patent: Feb. 13, 2018

(54) QUICK CONNECT WAVEGUIDE COUPLER USING PERTUBATIONS ROTATABLY MOVABLE THROUGH SLOTS BETWEEN A LOCKED POSITION AND AN UNLOCKED POSITION

(71) Applicant: RF elements s.r.o., Bratislava (SK)

(72) Inventors: Juraj Taptič, Zálesie (SK); Martin Marcinčák, Humenné (SK)

(73) Assignee: RF Elements S.R.O., Bratislava (SK)

( * ) Notice: Subject to any disclaimer, the term of this patent is extended or adjusted under 35 U.S.C. 154(b) by 104 days.

(21) Appl. No.: 14/879,266

(22) Filed: Oct. 9, 2015

(65) Prior Publication Data

US 2016/0104929 A1 Apr. 14, 2016

Related U.S. Application Data

(60) Provisional application No. 62/063,597, filed on Oct. 14, 2014.

(51) Int. Cl.
*H01P 1/04* (2006.01)
*H01Q 13/02* (2006.01)
*H01Q 19/13* (2006.01)

(52) U.S. Cl.
CPC ..... *H01P 1/042* (2013.01); *H01Q 13/02* (2013.01); *H01Q 19/13* (2013.01); *H01Q 19/134* (2013.01)

(58) Field of Classification Search
CPC ..... H01P 1/042
USPC ..... 333/255, 254
See application file for complete search history.

(56) References Cited

U.S. PATENT DOCUMENTS 2,892,987 A * 6/1959 Cedrone ..... H01P 1/042 174/21 R
3,019,041 A 1/1962 Scheublein, Jr. et al.
3,039,797 A * 6/1962 Harper et al. ..... H01P 1/042 285/395
3,241,144 A 3/1966 Berger
3,512,162 A 5/1970 Siebold et al.
3,898,666 A 8/1975 Massa
3,987,452 A 10/1976 Godet
4,157,876 A 6/1979 DiGiulio
4,515,336 A 5/1985 Fischer
4,623,858 A 11/1986 Montesanto et al.
4,755,830 A 7/1988 Plunk
(Continued)

OTHER PUBLICATIONS

Extended European Search Report dated Feb. 29, 2016 from corresponding European Patent Application No. 15189780.8, 9 pages.

*Primary Examiner* — Benny Lee
(74) *Attorney, Agent, or Firm* — Ohlandt, Greeley, Ruggiero & Perle L.L.P.

(57) ABSTRACT

A quick connect coupler assembly for connecting a first waveguide portion to a second waveguide portion is provided. The coupler assembly includes: a first coupler component affixed to the first waveguide portion and a second coupler component affixed to the second waveguide portion. The first coupler component has a plurality of perturbations, while the second coupler component has a plurality of slots and a radially disposed guide or channel. The perturbations align with and pass through the slots into the guide or channel such that the perturbations rotatably move about the guide or channel in a radial direction from an unlocked to a locked position.

9 Claims, 6 Drawing Sheets

(56) References Cited

U.S. PATENT DOCUMENTS

| | | | | |
|---|---|---|---|---|
| 5,402,139 | A | 3/1995 | Maeshima | |
| 5,790,910 | A | 8/1998 | Haskin | |
| 5,835,068 | A | 11/1998 | Paul et al. | |
| 5,867,132 | A | 2/1999 | Blasing et al. | |
| 5,870,062 | A * | 2/1999 | Cox | H01Q 19/13 333/239 |
| 6,045,103 | A | 4/2000 | Costa et al. | |
| 6,140,893 | A * | 10/2000 | Sciarrino | H01P 1/042 333/254 |
| 6,302,447 | B1 | 10/2001 | Lee | |
| 6,535,177 | B1 | 3/2003 | Dhellemmes et al. | |
| 6,664,937 | B2 | 12/2003 | Vermette et al. | |
| 6,911,950 | B2 | 6/2005 | Harron | |
| 7,142,168 | B1 | 11/2006 | Sinclair | |
| 7,265,732 | B2 | 9/2007 | Lin | |
| 7,439,930 | B2 | 10/2008 | Bury | |
| 7,748,670 | B1 | 7/2010 | Veldez | |
| 7,954,777 | B2 | 6/2011 | Bohm et al. | |
| 9,225,071 | B2 | 12/2015 | Lee et al. | |
| 2002/0084396 | A1 | 7/2002 | Weaver | |
| 2002/0105475 | A1 | 8/2002 | Overton et al. | |
| 2002/0125971 | A1* | 9/2002 | Sciarrino | H01P 3/14 333/254 |
| 2003/0090820 | A1 | 5/2003 | Matsuura et al. | |
| 2005/0024276 | A1 | 2/2005 | Izumi | |
| 2005/0127261 | A1 | 6/2005 | Lin | |
| 2008/0121767 | A1 | 5/2008 | Wimberley | |
| 2008/0165076 | A1 | 7/2008 | Pan | |
| 2010/0066633 | A1 | 3/2010 | Singer | |
| 2010/0315306 | A1 | 12/2010 | Strydesky | |

* cited by examiner

QUICK CONNECT WAVEGUIDE COUPLER USING PERTUBATIONS ROTATABLY MOVABLE THROUGH SLOTS BETWEEN A LOCKED POSITION AND AN UNLOCKED POSITION

CROSS REFERENCE TO RELATED APPLICATIONS

This application claims the benefit of U.S. Provisional Application Ser. No. 62/063,597 filed Oct. 14, 2014, the contents of which are incorporated by reference herein.

BACKGROUND

1. Field of the Disclosure

The present disclosure generally relates to a unique antenna waveguide quick connect coupler mechanism. In particular, the quick connect coupler is preferably disposed between a wave propagator, such as a radio, and an antenna.

2. Description of Related Art

Waveguides are a well known way of conducting electromagnetic energy between a source and a load, especially in microwave frequency bands, by propagation of electromagnetic waves inside of hollow or dielectric-filled pipe-like structures that have walls, where the walls are electrically conducting (e.g., made from metal). Waveguides offer several advantages, especially low loss, comparing with coaxial lines/cables, but thanks to their nature (i.e., a hollow, metallic pipe), their use is not as easy. Waveguides are often used in permanent connections, since their coupling is not as easy as with coaxial lines using coaxial connectors.

Thanks to such a robust mechanical nature (i.e., hollow metallic pipe), waveguides can be used for mechanical fixing of connected parts, besides conducting electromagnetic energy between the connected parts. One such application is the connecting an antenna to a wireless apparatus (e.g., transmitter/receiver) where the waveguide creates both a mechanical and electromagnetic connection.

Traditional methods of waveguide coupling use flanges at each side, which are then held together using several fasteners (e.g., screws and nuts), which has several disadvantages especially when frequent connection/disconnection is required, or they are operated at specific conditions (e.g., work at roof top, antenna mast, etc.), or when tools are required, operation with many small parts (e.g., screws, washers, nuts, etc.) are required and to reach repeatable results, even special tools might be necessary, such as moment spanners to provide uniform and accurate force at each fastener.

The present disclosure describes an efficient, quick, easy to use yet precise and robust way of creating a connection between two portions of waveguide, providing both electromagnetic and mechanical connections between connected portions.

The present disclosure also provides many additional advantages, which shall become apparent as described below.

SUMMARY OF THE INVENTION

The present disclosure describes an efficient, quick, easy to use, yet precise and robust way of creating a connection between two portions of waveguide, providing both electromagnetic and mechanical connection between connected portions, providing accurate rotatable alignment with optional accurate 90/180/270 degrees rotatable offset when required. The presented disclosure is shown with waveguides having a circular cross-section, but the waveguide may be adaptable to any other cross-section or shape with the understanding that some features that come with a rotational symmetric cross-section shape will be lost. The presented disclosure is described for applications where a horn-shaped or a parabolic reflector-shaped antenna is connected to a wireless device (e.g., a radio), but these applications should be meant as examples only, as the described quick coupler mechanism can be adopted to other applications as well.

A quick connect coupler assembly for connecting a first waveguide portion to a second waveguide portion, the coupler assembly comprising: a first coupler component affixed to the first waveguide portion, the first coupler component comprising a plurality of perturbations; and a second coupler component affixed to the second waveguide portion, the second coupler components comprising a plurality of slots and a radially disposed guide or channel; wherein the perturbations align with and pass through the slots into the guide or channel, such that the perturbation rotatably moves about the guide or channel in a radial direction from an unlocked to a locked position.

In some embodiments, the first waveguide is a wireless device and the second waveguide is either a horn-shaped antenna or a parabolic reflector-shaped antenna. The first and second coupler components are conical shaped. The first and second coupler components are at least partially formed of an elastomeric material.

The quick connect coupler assembly exhibits at least one of the following properties when the first and second coupler components are in the locked position: a low-loss electromagnetic coupling between the first and second waveguide portions; accurate and aligned mechanical connection in line with the longitudinal axis of first and second waveguide portions; ease of operation, connection and disconnection can be mated quickly; a connection which is sealed against environmental impact; and any combinations thereof.

The quick connect coupler assembly provides a rotatable alignment in a plane perpendicular to the longitudinal axis of first and second waveguide portions. Moreover, the quick connect coupler assembly provides for a rotatable offset of 90 degrees, 180 degrees or 270 degrees.

An alternative embodiment comprises a quick connect coupler assembly for connecting a first waveguide portion to a second waveguide portion, the coupler assembly comprising: a first coupler component affixed to the first waveguide portion, the first coupler component comprising a plurality of recessed portions; and a second coupler component affixed to the second waveguide portion, the second coupler components comprising a plurality of clips; wherein the clips align with the corresponding recessed portions, such that the first coupler component and the second coupler component are connected when the clips snap into the corresponding recessed portions.

Still yet another alternative embodiment is a quick connect coupler assembly for connecting a first waveguide portion to a second waveguide portion, the coupler assembly comprising: a first coupler component affixed to the first waveguide portion comprises a threaded female portion; and a second coupler component affixed to the second waveguide portion comprises a threaded male portion; wherein the first and second coupler components are connected by rotating the threaded female portion of the first coupler component about the threaded male portion of the second coupler component. Optionally, the first coupler component can include the threaded male portion and the second coupler component can include the threaded female portion.

The present disclosure also includes a method for connecting a first waveguide portion to a second waveguide portion via a quick connect coupler assembly comprising a first coupler component affixed to the first waveguide portion, the first coupler component comprising a plurality of perturbations, and a second coupler component affixed to the second waveguide portion, the second coupler components comprising a plurality of slots and a radially disposed guide or channel; the method comprising: aligning the perturbations of the first coupler component with the slots of the second coupler component; passing the perturbations through the slots into the guide or channel of the second coupler component; and rotating the perturbations about the guide or channel in a radial direction from an unlocked to a locked position.

Another method according to the present disclosure for connecting a first waveguide portion to a second waveguide portion via a quick connect coupler assembly comprising a first coupler component affixed to the first waveguide portion, the first coupler component comprising a plurality of recessed portions, and a second coupler component affixed to the second waveguide portion, the second coupler components comprising a plurality of clips; comprising: aligning the clips of the second coupler component with the corresponding recessed portions of the first coupler component; and passing the clips until they snap fit into the corresponding recessed portions.

Still yet another method for connecting a first waveguide portion to a second waveguide portion via a quick connect coupler assembly comprising a first coupler component affixed to the first waveguide portion comprises a threaded female portion, and a second coupler component affixed to the second waveguide portion comprises a threaded male portion; comprising: aligning the first coupler component with the second coupler component; and rotating the threaded female portion of the first coupler component about the threaded male portion of the second coupler component, thereby connecting the first coupler component with the second coupler component.

Further objects, features and advantages of the present disclosure will be understood by reference to the following drawings and detailed description.

DETAILED DESCRIPTION OF THE INVENTION

Figure 1:
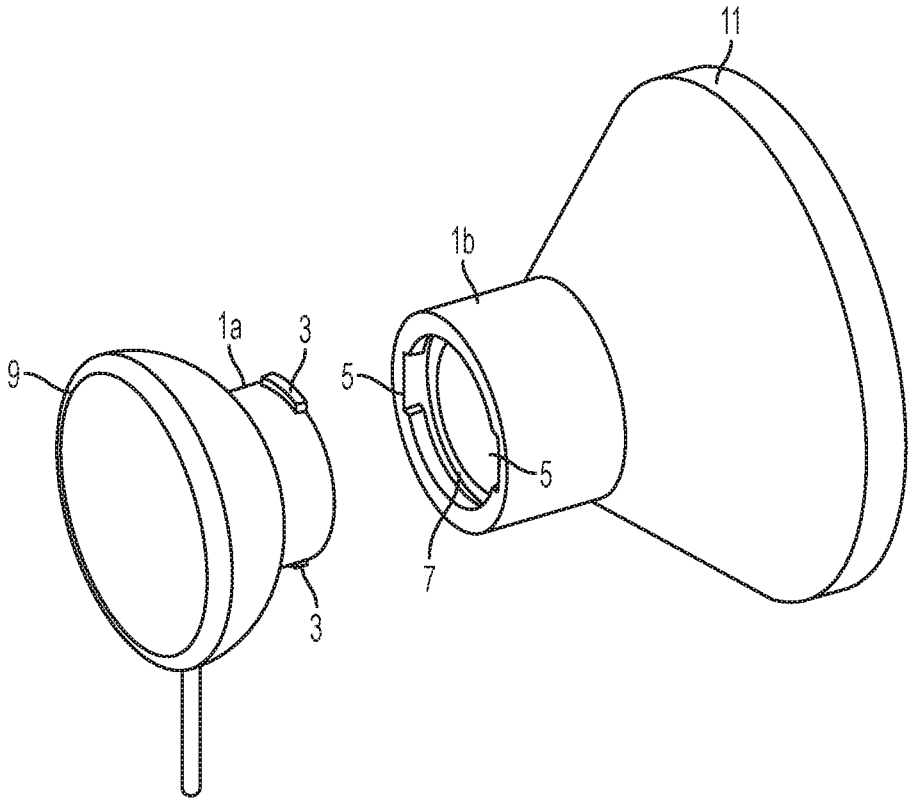
FIG. 1 is a left front perspective view of the quick connect coupler assembly according to a first embodiment of the present disclosure having a male to female connection between a wireless device and a horn-shaped antenna.

The present disclosure is best described by referring to the figures, where FIG. 1 depicts locking coupler components (1*a*, 1*b*), wherein male coupler component 1*a* include a pair of perturbations 3 which, when aligned with slots 5 disposed about coupler component 1*b*, are rotatably moved about guide 7, thereby securely locking coupler components 1*a* and 1*b* together. That is, waveguide portion 9 (e.g., wireless device) and waveguide portion 11 (e.g., horn-shaped antenna) are connected via locking coupler components (1*a*, 1*b*), thereby providing for (a) a low-loss electromagnetic coupling between waveguide portions (9, 11); (b) accurate and aligned mechanical connection in line with the longitudinal axis of waveguide portions (9, 11); (c) accurate rotatable alignment in plane perpendicular to longitudinal axis of portions (9, 11) with optional 90/180/270 accurate rotatable offset when required; (d) ease of operation (e.g., allowing for the use of a single hand to connect, without the need for any tools), connection and disconnection can be mated quickly; (e) optionally, a connection which is sealed against environmental impacts (e.g., rain/snow/humidity, etc.).

Figure 2:
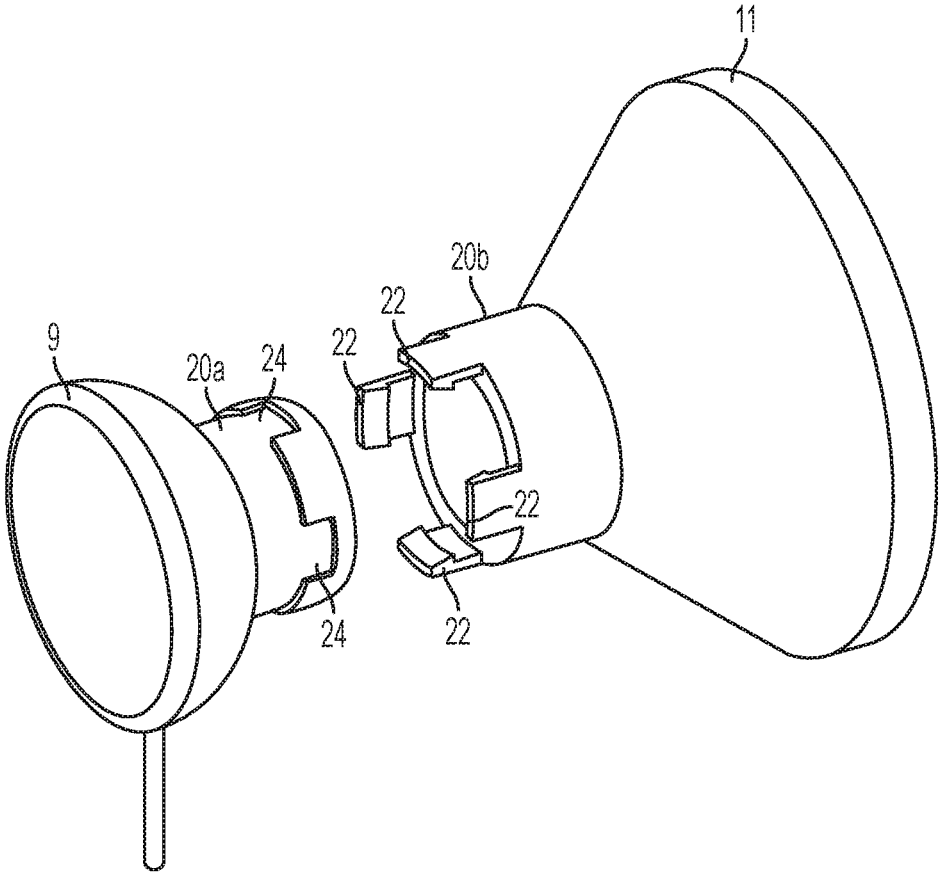
FIG. 2 is a left front perspective view of the quick connect coupler assembly according to a second embodiment of the present disclosure having a female to male connection between a wireless device and a horn-shaped antenna.

FIG. 2 is a left front perspective view of the quick connect coupler assembly according to a second embodiment of the present disclosure having a female locking coupler component 20*a* to male locking coupler component 20*b* between wireless device 9 and horn-shaped antenna 11. This embodiment shown in FIG. 2 utilizes clips 22 disposed about locking coupler component 20*b* which lock in place about associated recesses 24 disposed about locking coupler component 20*a*.

Figure 3:
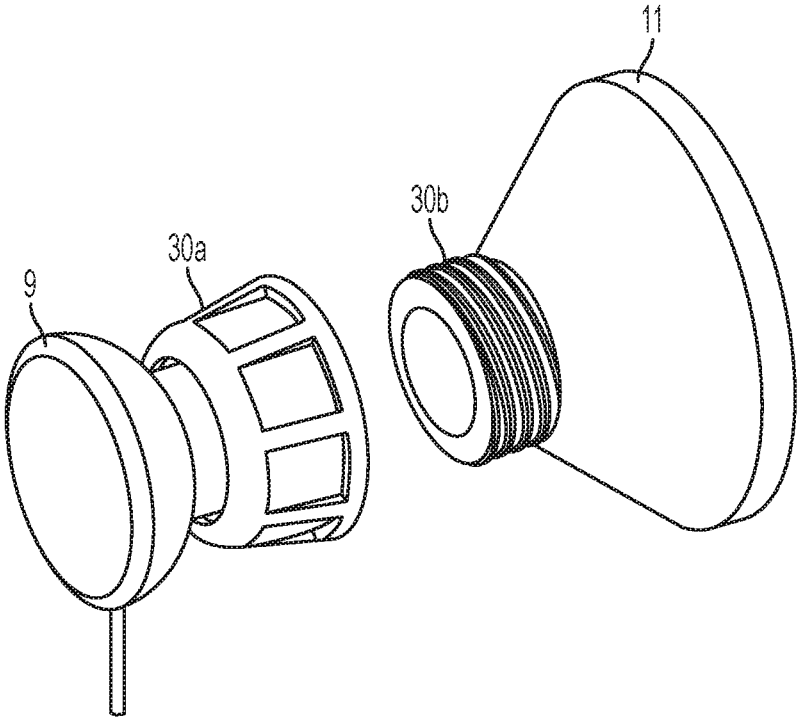
FIG. 3 is a left front perspective view of the quick connect coupler assembly according to a third embodiment of the present disclosure having a threaded connection between a wireless device and a horn-shaped antenna.

According to yet another embodiment shown in FIG. 3, locking coupler components 30*a* and 30*b* are locked together by tightening (rotating) of thread-containing locking coupler components 30*a* and 30*b* to secure wireless device 9 and horn-shaped antenna 11. Optionally, the first coupler component can include either a threaded female/male portion, as long as the second coupler component includes the opposite threaded female/male portion.

Figure 4:
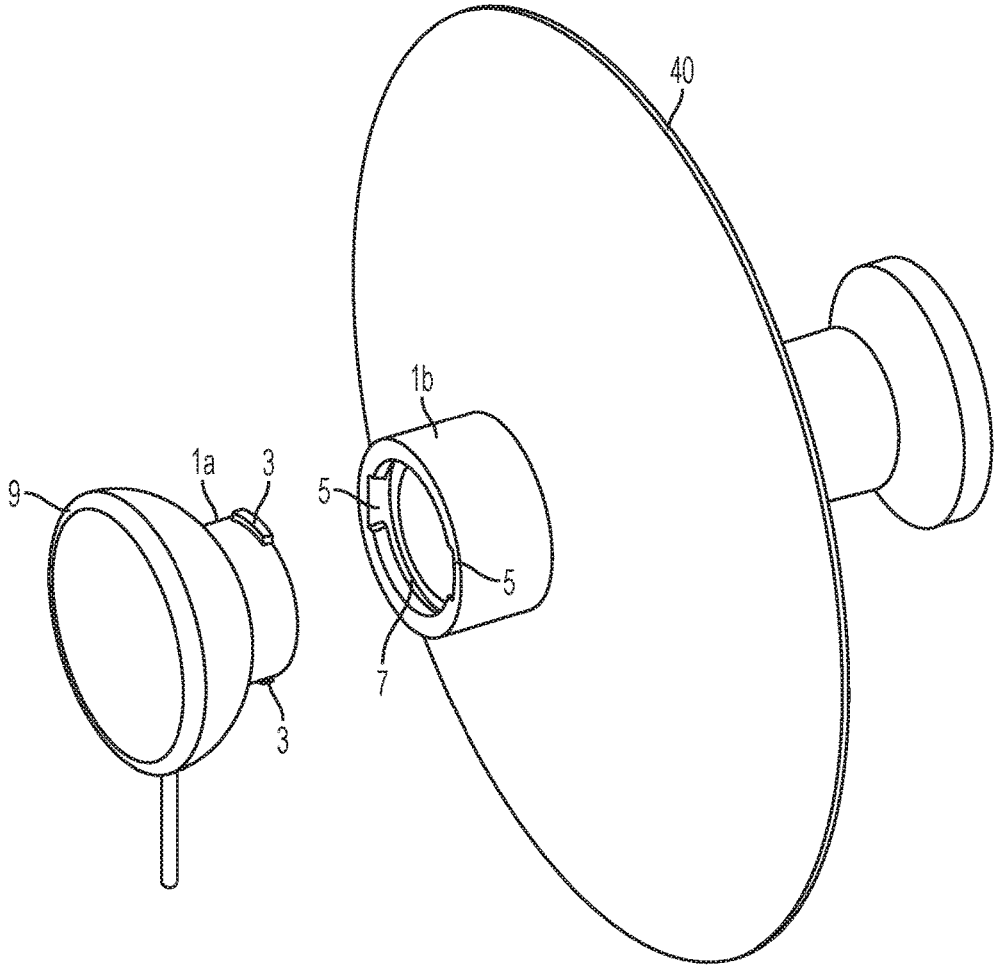
FIG. 4 is a left front perspective view of the quick connect coupler assembly according to the first embodiment of the present disclosure having a male to female connection between the wireless device and a parabolic reflector-shaped antenna.
Figure 5:
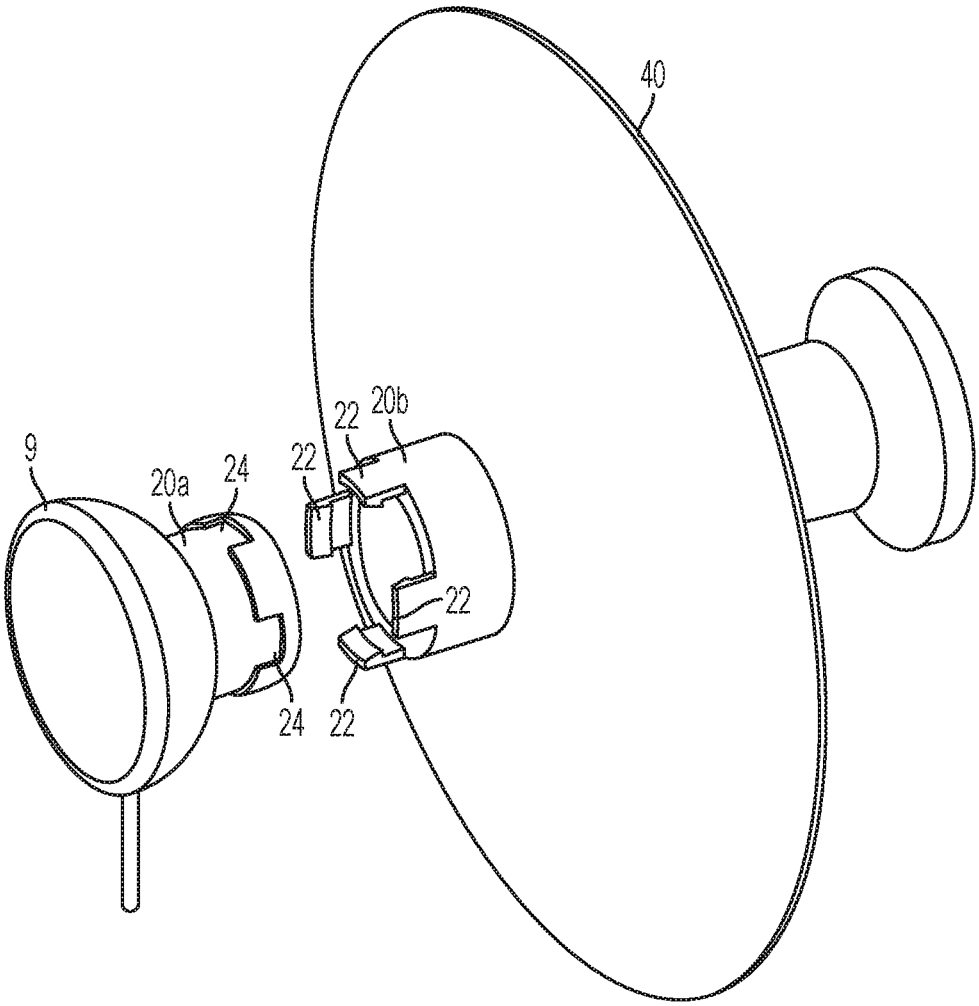
FIG. 5 is a left front perspective view of the quick connect coupler assembly according to the second embodiment of the present disclosure having a female to male connection between the wireless device and a parabolic reflector-shaped antenna.
Figure 6:
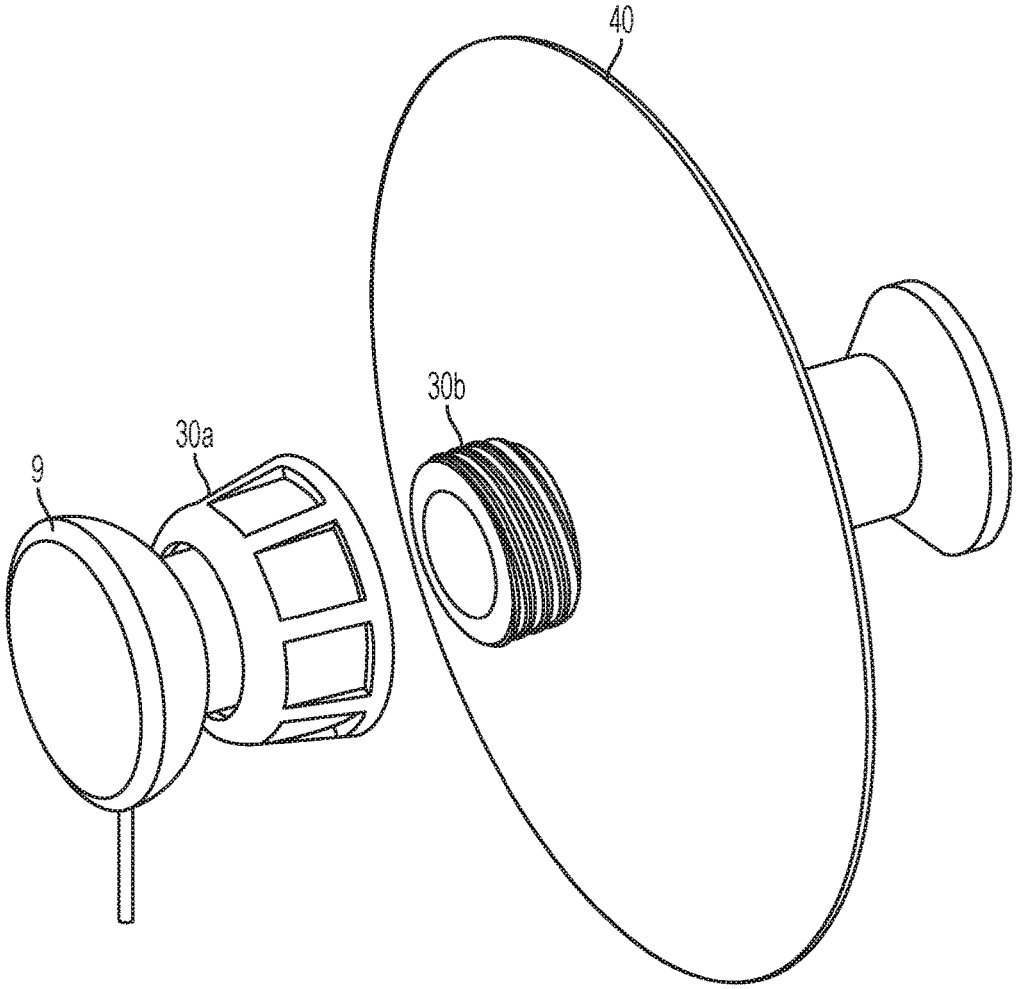
FIG. 6 is a left front perspective view of the quick connect coupler assembly according to the third embodiment of the present disclosure having a threaded connection between a wireless device and a parabolic reflector-shaped antenna.

FIGS. 4-6 are similar to FIGS. 1-3, respectively, except that instead of waveguide portion 11 being a horn-shaped antenna 11 as in FIGS. 1-3, a parabolic reflector-shaped antenna 40 is connected to waveguide portion 9 in FIGS. 4-6.

In the embodiment of FIG. 4, male coupler component 1*a* includes a pair of perturbations 3 which, when aligned with slots 5 disposed about coupler component 1*b*, are rotatably moved about guide 7, thereby securely locking coupler components 1*a* and 1*b* together.

In the embodiment of FIG. 5, female locking coupler component 20*a* and male locking coupler component 20*b* are shown between wireless device 9 and parabolic reflector-shaped antenna 40 and includes clips 22 disposed about locking coupler component 20*b* which lock in place about associated recesses 24 disposed about locking coupler component 20*a*.

In the embodiment of FIG. 6, locking coupler components 30*a* and 30*b* are locked together by tightening (rotating) of thread-containing locking coupler components 30*a* and 30*b* to secure wireless device 9 and parabolic reflector-shaped antenna 40.

To provide alignment in-line with a longitudinal axis, locking coupler components in FIGS. 1-6 preferably are of a conical shape, although any shape that provides for in-line alignment along the longitudinal axis is acceptable.

To provide compensation for possible variation of dimensions (e.g., thermal expansion, aging, etc.) and to keep locking force stable, locking coupler components can contain elastic members which are pre-deformed when locked and deformation force created by such a deformation then maintain controlled locking force even when dimensions of parts change slightly. That is, the first and second coupler components are at least partially formed of an elastomeric material.

While the present disclosure has shown and described several embodiments in accordance with the present invention, it is to be clearly understood that the same may be susceptible to numerous changes apparent to one skilled in the art. Therefore, the present disclosure is not limited to the details shown and described but is intended to include all changes and modifications that come within the scope of the appended claims.

What is claimed is:

1. A quick connect coupler assembly for connecting a first waveguide portion to a second waveguide portion, the coupler assembly comprising:

a first coupler component configured to be affixed to the first waveguide portion, the first coupler component comprising a plurality of perturbations; and a second coupler component configured to be affixed to the second waveguide portion, the second coupler component comprising a plurality of slots and a radially disposed guide or channel, wherein the plurality of perturbations align with and pass through the plurality of slots into the guide or channel, such that the plurality of perturbations rotatably move about the guide or channel in a radial direction between an unlocked position and a locked position, wherein the first and second coupler components provide a connection that is a rotatable in a plane perpendicular to a longitudinal axis of the first and second waveguide portions, and wherein the connection provides a rotatable offset of an orientation selected from the group consisting of 90 degrees, 180 degrees, and 270 degrees.

2. A quick connect coupler assembly for connecting a first waveguide portion to a second waveguide portion, the coupler assembly comprising:

a first coupler component configured to be affixed to the first waveguide portion, the first coupler component comprising a plurality of perturbations; and a second coupler component configured to be affixed to the second waveguide portion, the second coupler component comprising a plurality of slots and a radially disposed guide or channel, wherein the plurality of perturbations align with and pass through the plurality of slots into the guide or channel, such that the plurality of perturbations rotatably move about the guide or channel in a radial direction between an unlocked position and a locked position, and wherein the first and second coupler components have a conical shape.

3. A quick connect coupler assembly for connecting a first waveguide portion to a second waveguide portion, the coupler assembly comprising:

a first coupler component configured to be affixed to the first waveguide portion, the first coupler component comprising a plurality of perturbations; and a second coupler component configured to be affixed to the second waveguide portion, the second coupler component comprising a plurality of slots and a radially disposed guide or channel, wherein the plurality of perturbations align with and pass through the plurality of slots into the guide or channel, such that the plurality of perturbations rotatably move about the guide or channel in a radial direction between an unlocked position and a locked position, and wherein the first and second coupler components are at least partially formed of an elastomeric material.

4. A quick connect coupler assembly for connecting a first waveguide portion to a second waveguide portion, the coupler assembly comprising:

a first coupler component configured to be affixed to the first waveguide portion, the first coupler component comprising a plurality of perturbations; and a second coupler component configured to be affixed to the second waveguide portion, the second coupler component comprising a plurality of slots and a radially disposed guide or channel, wherein the plurality of perturbations align with and pass through the plurality of slots into the guide or channel, such that the plurality of perturbations rotatably move about the guide or channel in a radial direction between an unlocked position and a locked position, and wherein, when in the locked position, the first and second coupler components provide a connection that is sealed against environmental impact.

5. The assembly according to any one of claims 2, 3, 4, and 1, wherein the second coupler component is affixed to the second waveguide portion, and wherein the second waveguide portion is an antenna.

6. The assembly according to claim 5, wherein antenna is a horn-shaped antenna or a parabolic reflector-shaped antenna.

7. The assembly according to any one of claims 2, 3, 4, and 1, wherein, when in the locked position, the first and second coupler components provide a connection having a low-loss electromagnetic coupling between the first and second waveguide portions.

8. The assembly according to any one of claims 2, 3, 4, and 1, wherein, when in the locked position, the first and second coupler components provide a connection that is in line with a longitudinal axis of the first and second waveguide portions.

9. The assembly according to any one of claims 2, 3, 4, and 1, wherein the first coupler component is affixed to the first waveguide portion, and wherein the first waveguide portion is a wireless device.

* * * * *